US007510412B1

(12) United States Patent
Valentin

(10) Patent No.: US 7,510,412 B1
(45) Date of Patent: Mar. 31, 2009

(54) TAMPER RESISTANT ASSEMBLY FOR AN ELECTRICAL RECEPTACLE

(75) Inventor: William Ramon Valentin, Meriden, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 12/068,548

(22) Filed: Feb. 7, 2008

(51) Int. Cl.
*H01R 13/44* (2006.01)

(52) U.S. Cl. ..... 439/145; 439/137

(58) Field of Classification Search ..... 439/137, 439/139, 145, 141, 146; 200/51 R
See application file for complete search history.

(56) References Cited

U.S. PATENT DOCUMENTS

| | | | | |
|---|---|---|---|---|
| 2,545,536 | A | 3/1951 | Holtz | |
| 3,173,731 | A | 3/1965 | Anderson | |
| 4,379,607 | A | 4/1983 | Bowden, Jr. | |
| 4,544,219 | A | 10/1985 | Barkas | |
| 5,020,997 | A | 6/1991 | Calderara | |
| 5,702,259 | A * | 12/1997 | Lee | 439/137 |
| 5,915,981 | A * | 6/1999 | Mehta | 439/137 |
| 6,050,834 | A | 4/2000 | Moody | |
| 6,056,564 | A | 5/2000 | Huang | |
| 6,422,880 | B1 * | 7/2002 | Chiu | 439/137 |
| 6,537,089 | B1 * | 3/2003 | Montague | 439/145 |
| 6,555,771 | B2 * | 4/2003 | Shao | 200/51 R |
| 7,179,992 | B1 | 2/2007 | Packard | |

* cited by examiner

*Primary Examiner*—Hien Vu
(74) *Attorney, Agent, or Firm*—Marcus R. Mickney; Mark S. Bicks; Alfred N. Goodman

(57) ABSTRACT

A tamper resistant assembly provides tamper resistance to an electrical receptacle. A groove has a locking portion connected to a first portion in a base member of the tamper resistant assembly. A first shutter member having first and second resilient arms is slidably connected to the base member. First and second protrusions extend rearwardly from the first and second resilient arms, respectively, and are slidably received in the groove in the base member. The first and second protrusions are disposed in the locking portion of the groove when the shutter member is in a closed position and in the first portion when the shutter member is in an open position. The locking portion prevents separation of the first and second protrusions in the closed position to prevent the first and second resilient arms from being separated and to prevent insertion of an object therebetween.

17 Claims, 10 Drawing Sheets

TAMPER RESISTANT ASSEMBLY FOR AN ELECTRICAL RECEPTACLE

FIELD OF THE INVENTION

The present invention relates to a tamper resistant assembly for an electrical receptacle. More particularly, the present invention relates to a tamper resistant electrical receptacle adapted to receive both 15 and 20 amp plugs. Still more particularly, the present invention relates to a tamper resistant assembly for an electrical receptacle in which the base member of the tamper resistant assembly has a groove for receiving a protrusion of a shutter member to prevent accidental movement of the shutter member.

BACKGROUND OF THE INVENTION

A group of electrical receptacles is referred to as "protective" receptacles because some measure has been taken in the construction to protect children and others from harm if they should intentionally or inadvertently insert or attempt to insert an electrically conductive article into the electrically energized portions of the receptacle. Conventional electrical receptacles have a nonconductive face portion with openings to receive plug blades. In normal use, the blades pass through the nonconductive space and are received by conductive female elements that are connected to line voltage. A child inserting, for example, a paper clip or the conductive portion of a toy into the energized conductive elements can be seriously injured.

To avoid this danger, "shuttered" receptacles prevent insertion of anything other than the blades of an appropriate plug by elements provided between the faceplate and the conductive elements. The electrical energization of internal components is not controlled; rather, access to those conductive elements is prevented except under a defined set of circumstances.

An example of a shuttered receptacle is found in U.S. Pat. No. 4,379,607 to Bowden, Jr. (the Bowden '607 patent), the subject matter of which is hereby incorporated by reference. The Bowden '607 patent discloses two identical slideable shutter members 56 provided behind the slots 70 in the cover 54 and in front of the terminals 68 within the receptacle base 52, as shown in FIGS. 1, 2 and 7. Each of the two identical shutter members has a cam surface 108 and a blocking portion 106. The cam surfaces 108 are positioned so that each one is contacted by a blade and is caused to move so that its blocking portion unblocks the slot for the other blade. Thus, when the two blades are concurrently inserted, they act against the two cam surfaces and unblock each other's passageways.

While this structure appears to be quite suitable for its intended purpose, and while it does have the advantage of permitting the use of shuttering in a grounded plug and receptacle, the design is such that it can only be used with plugs having parallel blades such as type 1-15 P and 5-15 P.

As is well known, however, plugs and receptacles used in the home as well as in offices and other circumstances at the present time include configurations, such as 20 amp plugs, in which the plug blades are perpendicular to each other rather than being parallel (as in 15 amp plugs). Electrical receptacles are generally configured to be able to receive both 15 and 20 amp plugs. The slideable shutter members of the Bowden '607 patent do not provide tamper resistance for an electrical receptacle adapted to receive both 15 and 20 amp plugs.

Thus, there is a continuing need to provide improved tamper resistant assemblies for electrical receptacles adapted to receive both 15 and 20 amp plugs.

SUMMARY OF THE INVENTION

Accordingly, it is a primary objective of the present invention to provide an improved tamper resistant assembly for an electrical receptacle.

A further objective of the present invention is to provide an improved tamper resistant assembly for an electrical receptacle adapted to receive both 15 and 20 amp plugs.

A still further objective of the present invention is to provide an improved tamper resistant receptacle adapted to receive both 15 and 20 amp plugs.

The foregoing objectives are basically attained by a tamper resistant assembly including a base member and a first shutter member. A groove has a locking portion connected to a first portion in the base member. A first shutter member having first and second resilient arms is slidably connected to the base member. First and second protrusions extend rearwardly from the first and second resilient arms, respectively, and are movably received in the groove in the base member. The first and second protrusions are disposed in the locking portion of the groove when the shutter member is in a closed position and in the first portion when the shutter member is in an open position. The locking portion prevents separation of the first and second protrusions in the close position to prevent the first and second resilient arms from being separated and to prevent insertion of an object therebetween.

The foregoing objectives are also basically attained by an electrical receptacle adapted to receive both 15 and 20 amp plugs and having a tamper resistant assembly disposed therein. A front cover has first and second guide ribs connected thereto, and a back housing secured to the front cover. A tamper resistant assembly is disposed between the front cover and the back housing, and includes a base member and a first shutter member. The base member has first and second guide grooves received by the first and second guide ribs to align the tamper resistant assembly with the front cover. A first groove has a locking portion connected to a first portion in the base member. The shutter member is slidably connected to the base member and has first and second resilient arms. First and second protrusions extend rearwardly from the first and second resilient arms, respectively, and are movably received in the first groove in the base member. The first and second protrusions are disposed in the locking portion of the first groove when the shutter member is in a closed position and in the first portion when the shutter member is in an open position. The locking portion prevents separation of the first and second protrusions in the close position to prevent the first and second resilient arms from being separated and to prevent insertion of an object therebetween.

Other objects, advantages and salient features of the invention will become apparent from the following detailed description, which, taken in conjunction with the annexed drawings, discloses a preferred embodiment of the invention.

As used in this application, the terms "front", "rear", "upwardly" and "downwardly" are intended to facilitate the description of the tamper resistant electrical receptacle, and are not intended to limit the structure of the tamper resistant electrical receptacle to any particular position or orientation.

BRIEF DESCRIPTION OF THE DRAWINGS

The above aspects and features of the present invention will be more apparent from the description for an exemplary embodiment of the present invention taken with reference to the accompanying drawings, in which.

Throughout the drawings, like reference numerals will be understood to refer to like parts, components and structures.

DETAILED DESCRIPTION OF EXEMPLARY EMBODIMENTS

As shown in FIGS. 1-11, the present invention includes a tamper resistant electrical receptacle 10. A tamper resistant assembly 31 provides tamper resistance for an electrical receptacle 10 adapted to receive both 15 and 20 amp plugs.

Figure 2:
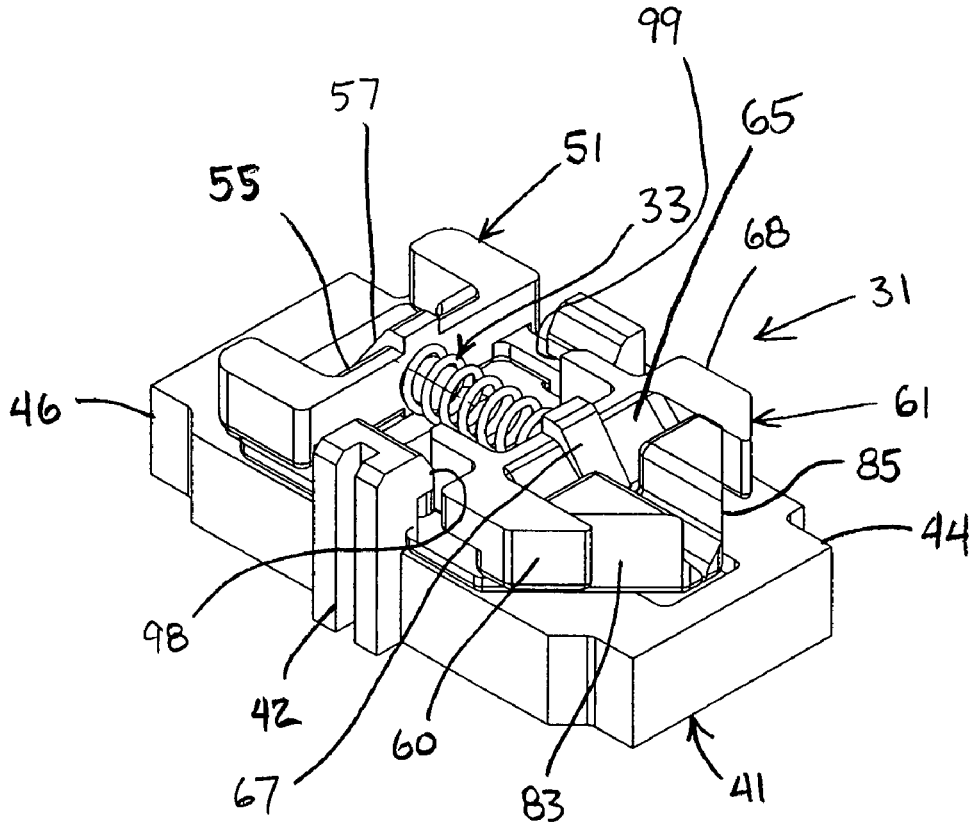
FIG. 2 is a perspective view of a tamper resistant assembly according to an exemplary embodiment of the present invention.
Figure 3:
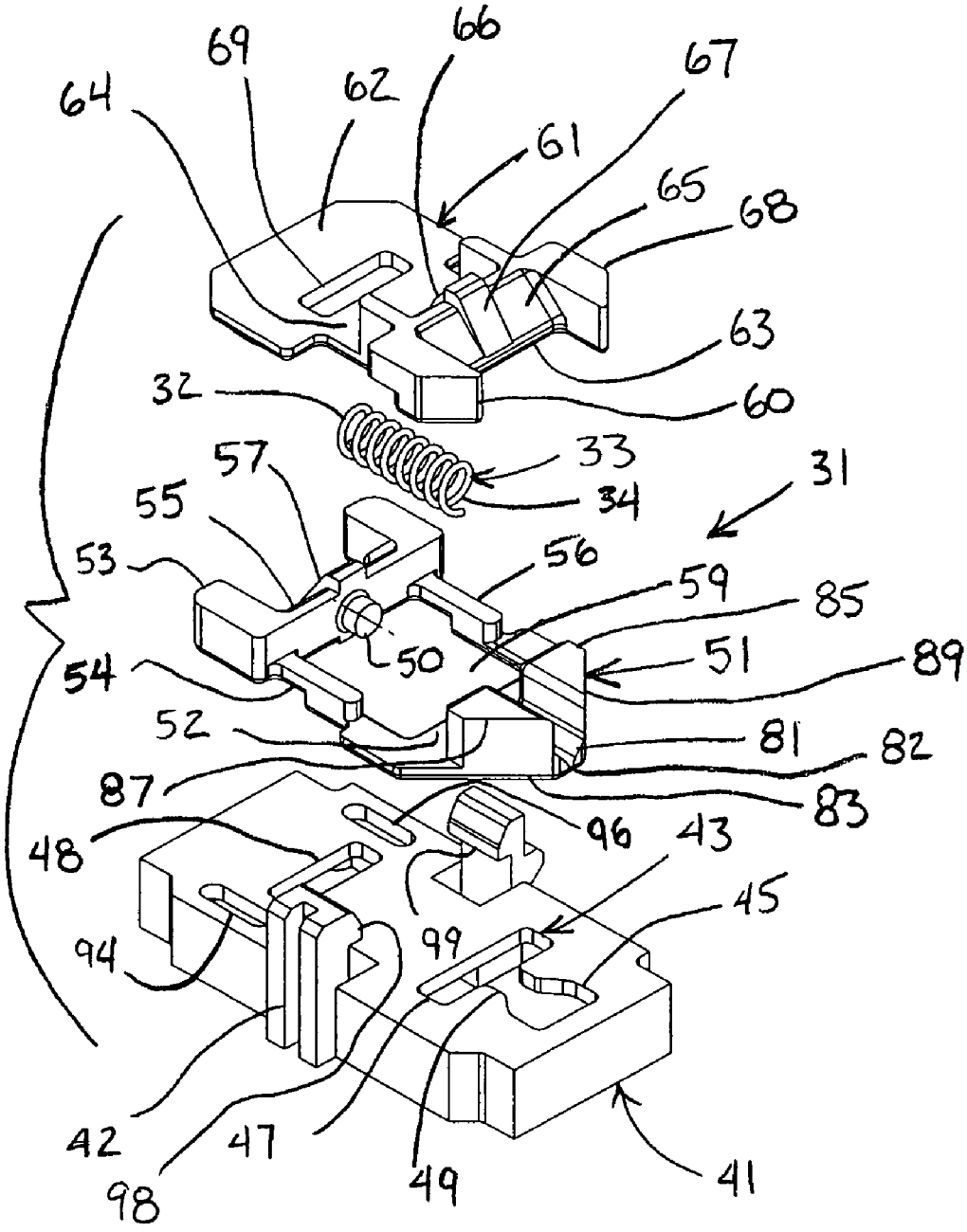
FIG. 3 is an exploded perspective view of the tamper resistant assembly of FIG. 2.
Figure 5:
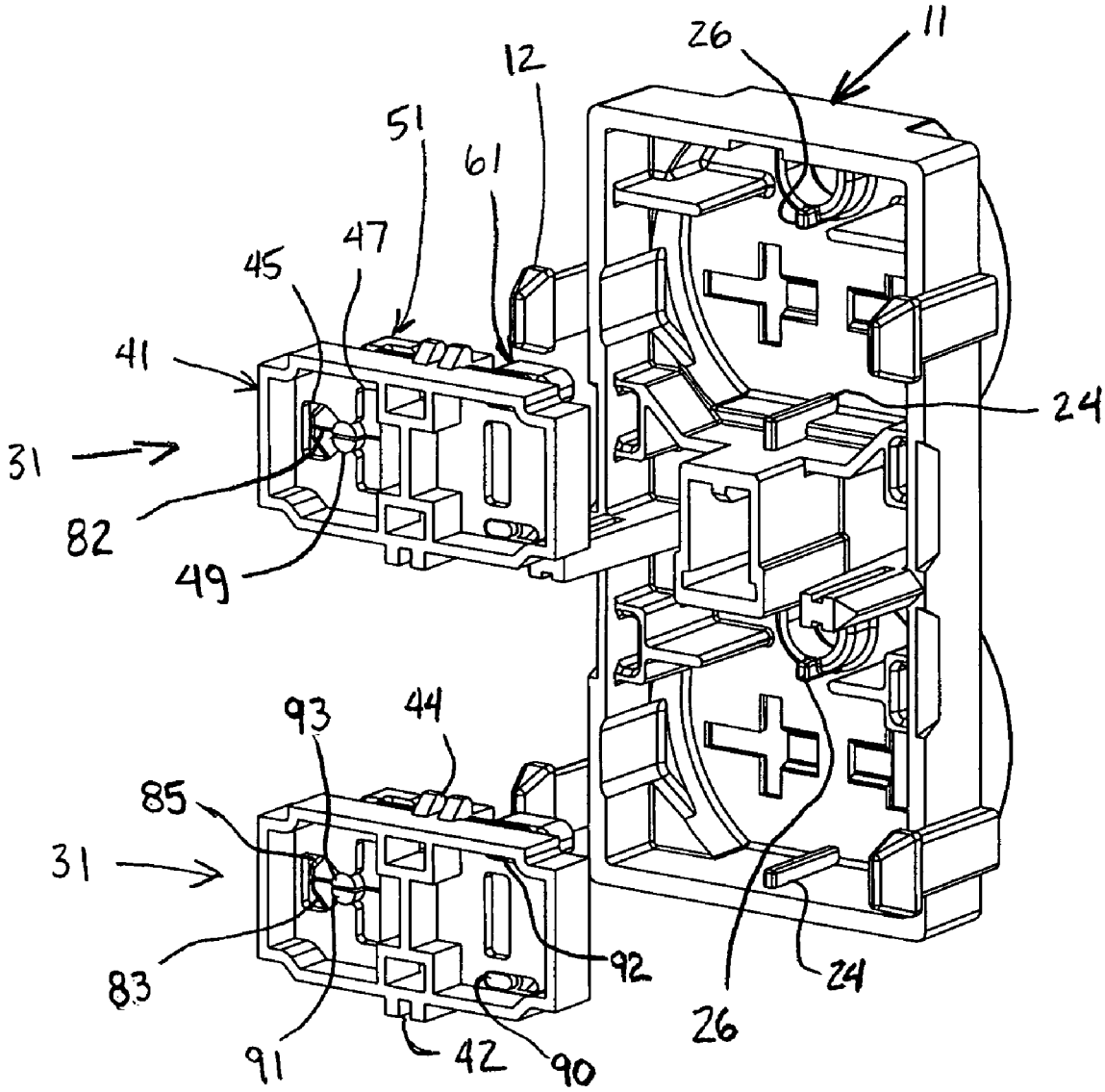
FIG. 5 is a rear perspective view of the tamper resistant assembly and front cover of FIG. 4.
Figure 11:
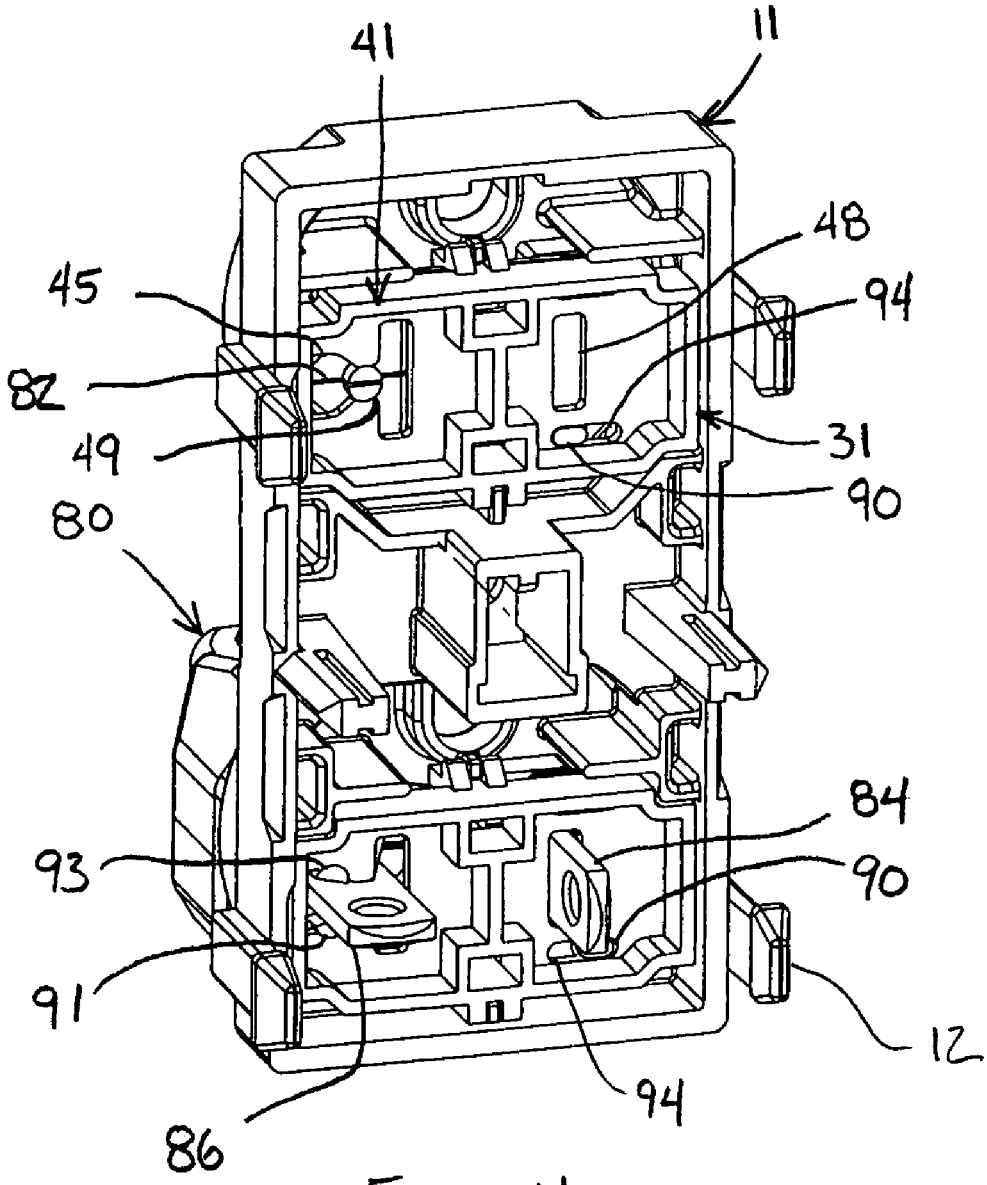
FIG. 11 is a rear perspective view of a plug being correctly inserted in an electrical receptacle of FIG. 1 in which the rear housing has been removed for clarity.

The tamper resistant assembly 31, as shown in FIGS. 2 and 3, includes a base member 41, a first shutter member 51, a second shutter member 61 and a spring 33. A groove 43 is formed in the base member 41 and has a first portion 45 and a second portion 47 separated by a locking portion 49. First shutter member 51 is slidably connected to the base member 41. A protrusion 91 extends rearwardly from the first shutter member 51 and is movably received in the groove 43 in the base member 41, as shown in FIG. 5. The protrusion 91 is disposed in the first portion 45 of the groove 43 when in an open position, as shown in FIG. 11, and in the locking portion 49 when in the closed position. The locking portion 49 prevents outward movement of the protrusion 91 to prevent accidental movement of the first shutter member 51 from the first portion 45 to the second portion 47 of the groove 43.

Figure 1:
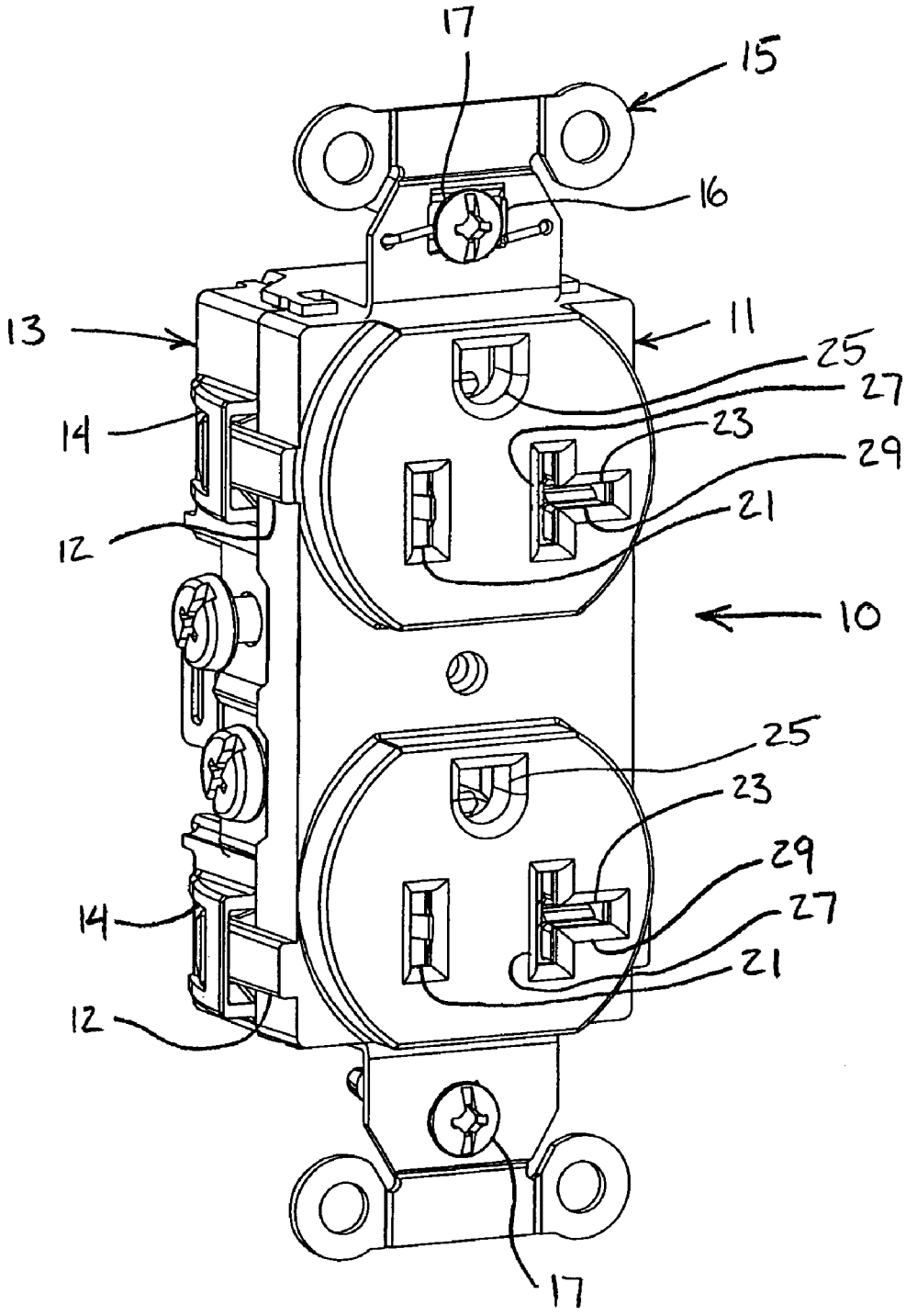
FIG. 1 is a perspective view of an assembled electrical receptacle including a tamper resistant assembly according to an exemplary embodiment of the present invention.

The electrical receptacle 10 has a front cover 11 connected to a back housing 13 with a ground strap 15 connected thereto, as shown in FIG. 1. The ground strap 15 has openings 16 disposed at opposite ends adapted to receive fasteners 17 to connect the electrical receptacle 10 to an electrical box (not shown). The ground strap 15 may extend around a rear surface of the back housing 15 as shown in FIG. 1, or may, alternatively, be disposed between the front cover 11 and the back housing 13. A plurality of arms 12 extend rearwardly from the front cover 11 and are received by receptacles 14 of the back housing 13 to connect the front cover to the back housing. Conductive elements (not shown) are disposed within the back housing 13 to receive and make electrical contact with inserted blades 22 and 28 of an electrical plug 20, as shown in FIG. 10.

The front cover 11 has openings suitably disposed to receive the prongs and blades of a conventional male plug. The electrical receptacle shown in FIGS. 1 and 4-10 is a duplex electrical receptacle, although the present invention is not limited thereto. A first opening 21 and a second opening 23 are disposed in the front cover 11 to receive the blades that form part of the power circuit for the appliance being connected thereto. A third opening 25 receives the ground prong of a grounded three-prong connector. The first opening 21 is substantially rectangular in shape and the second opening 23 is substantially T-shaped. The second opening 23 may receive a plug blade that is either substantially parallel to the blade passing through the first opening 21, or that is substantially perpendicular to the blade passing through the first opening. The second opening 23 has a first portion 27 substantially parallel to the first opening 21 and a second portion 29 substantially perpendicular to the first opening 21 (as well as being substantially perpendicular to the first portion 27 of the second opening 23).

Figure 9:
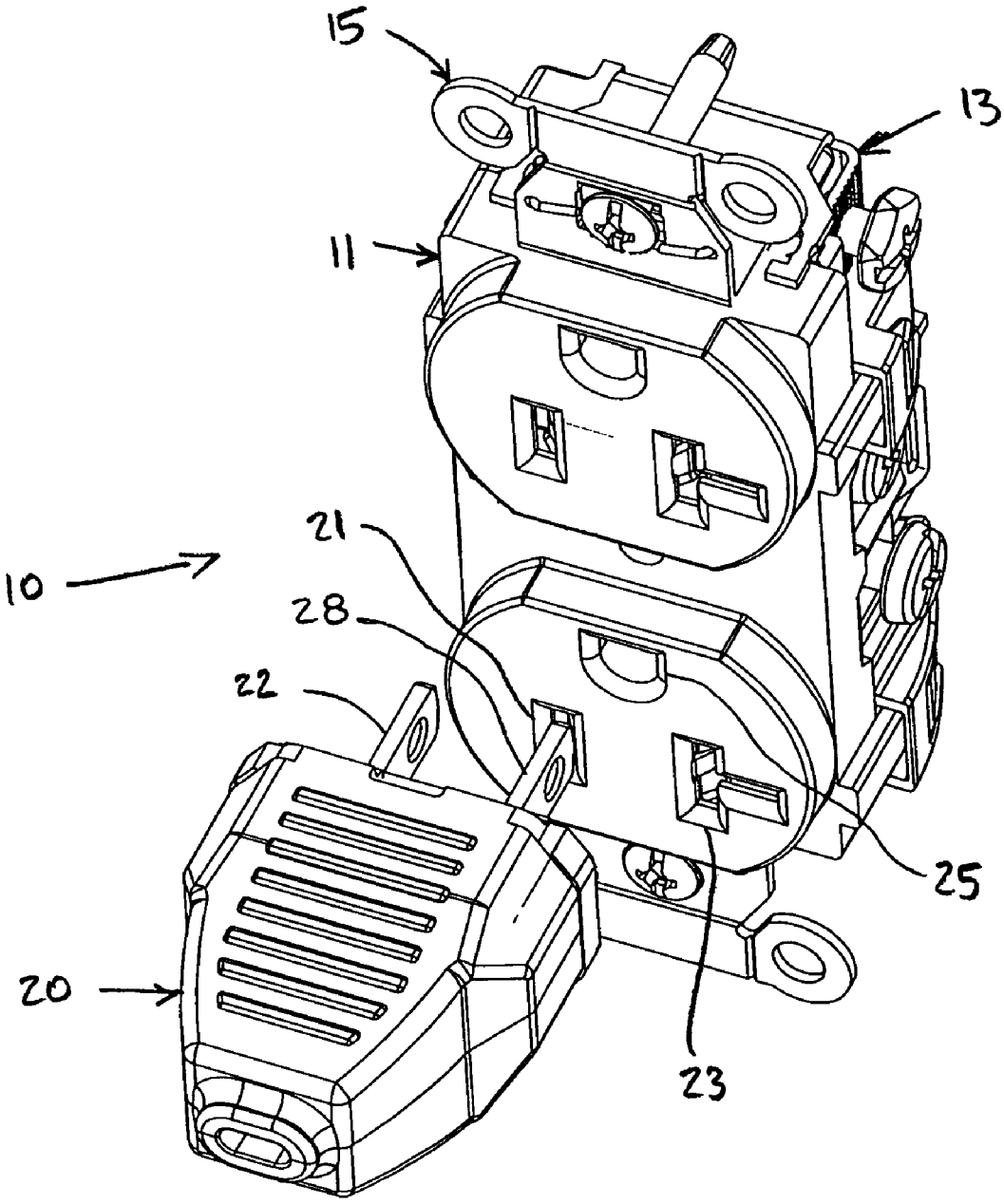
FIG. 9 is a front perspective view of a plug being incorrectly inserted in a slot in the front cover of the electrical receptacle of FIG. 1.
Figure 10:
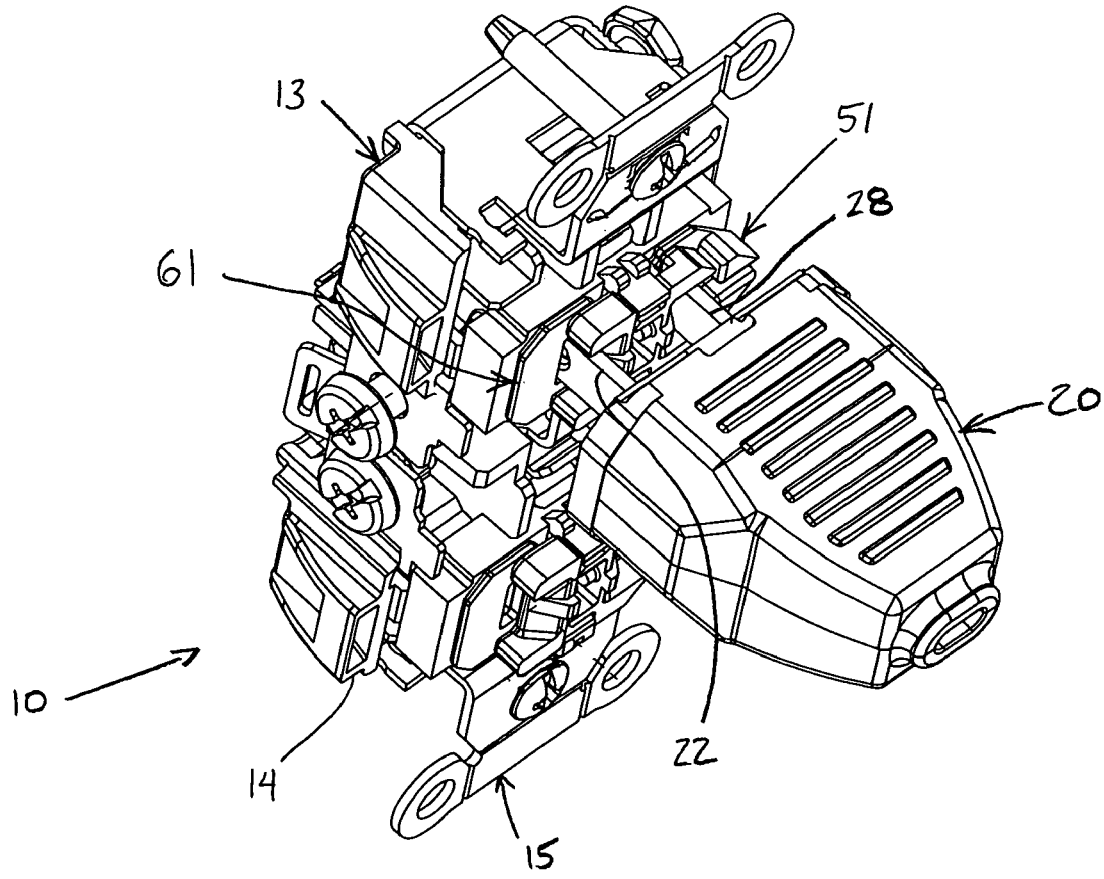
FIG. 10 is a front perspective view of a plug being correctly inserted in an electrical receptacle of FIG. 1 in which the front cover has been removed for clarity.

A plug 20 in which the two blades passing through the first and second openings 21 and 23 are substantially parallel is referred to as a parallel blade plug, such as a 15 amp plug shown in FIGS. 9 and 10. A plug 80 that has the blade 86 passing through the second opening 23 disposed in a plane substantially perpendicular to the plane in which the blade 84 passing through the first opening 21 is an orthogonal blade plug, such as a 20 amp plug shown in FIG. 11. The ground prong is typically substantially D-shaped in cross-section, and is generally longer than the blades passing through the first and second openings 21 and 23. However, the shutter assembly shown and described does not interfere with the presence of such a grounding plug.

In the exploded view of FIGS. 2 and 3, the first shutter member 51 has at one end thereof a first blocking portion 52, which is substantially planar and faces toward the second opening 23 in the front cover 11 of the electrical receptacle 10 through which a plug blade is inserted. The first shutter member 51 shown in FIGS. 2 and 3 is generally referred to as a "scissor-style" shutter. The first blocking portion 52 is positioned below the first portion 27 of the second opening 23 to prevent a foreign object or a single plug blade inserted therethrough from contacting the electrical contact. The first shutter member 51 also includes a first cam body 53 having an inclined cam surface 55 formed thereon. An accelerator ramp 57 is disposed on the cam surface 55 and is raised above the cam surface. Preferably, the accelerator ramp 57 is centrally located on the cam surface. The accelerator ramp 57 is adapted to be engaged by various sized plug blades from different manufacturers and accelerates the movement of the first shutter member 51 to compensate for the different manufacturers' plug designs. The cam surface 55 faces away from the blocking portion 52. The cam body 53 is connected to the blocking portion by side arms 54 and 56, thereby defining an opening 59. Preferably, the side arms 54 and 56 are substantially parallel, and the opening is substantially rectangular. A generally cylindrical guide rod 50 extends outwardly from the cam body 53 toward the blocking portion 52 and is adapted to receive an end 32 of a compression coil spring 33, which urges the first and second shutter members 51 and 61 toward their normal, relaxed position when no plug blades are present.

Figure 6:
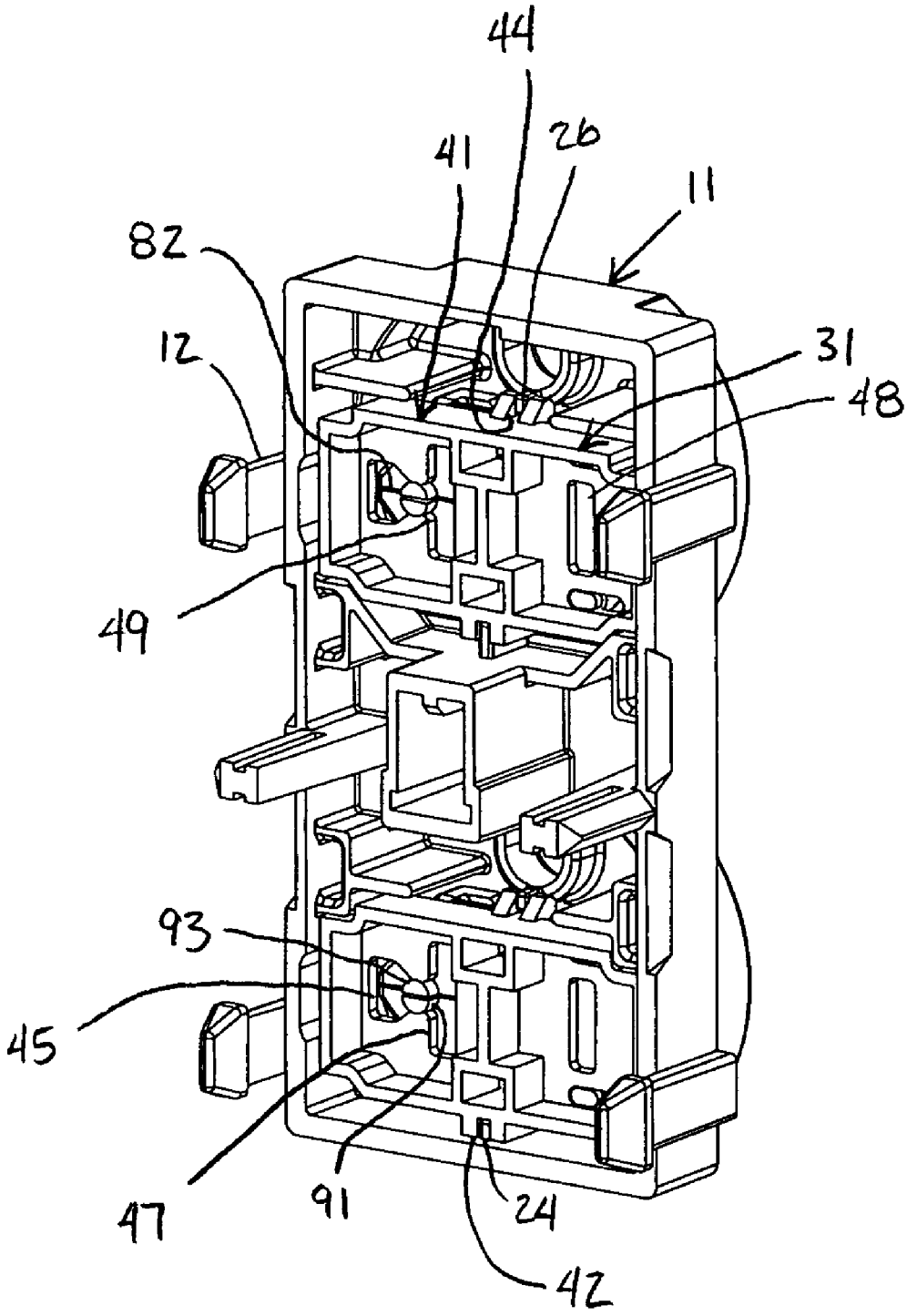
FIG. 6 is a rear perspective view of the tamper resistant assembly connected to the front cover of FIG. 4.

A second blocking portion 81 has first and second resilient arms 83 and 85 extending from the first blocking portion 52 toward each other. When the first shutter member 51 is slidably connected to the base member 41 with the second shutter member 61, the resilient arms 83 and 85 are pressed together such that there is no gap in a blade entry slot 82 defined by the first and second resilient arms 83 and 85, as shown in FIGS. 5 and 6. The first and second resilient arms 83 and 85 separate to form a gap in the blade entry slot 82 such that an inserted plug blade may pass therebetween, as shown in FIG. 11. Projections 87 and 89 protrude forwardly from the resilient arms 83 and 85, respectively, and are received between first and second locking arms 60 and 68 of the second shutter member 61 when the first and second shutter members 51 and 61 are slidably connected to the base member 41.

Figure 4:
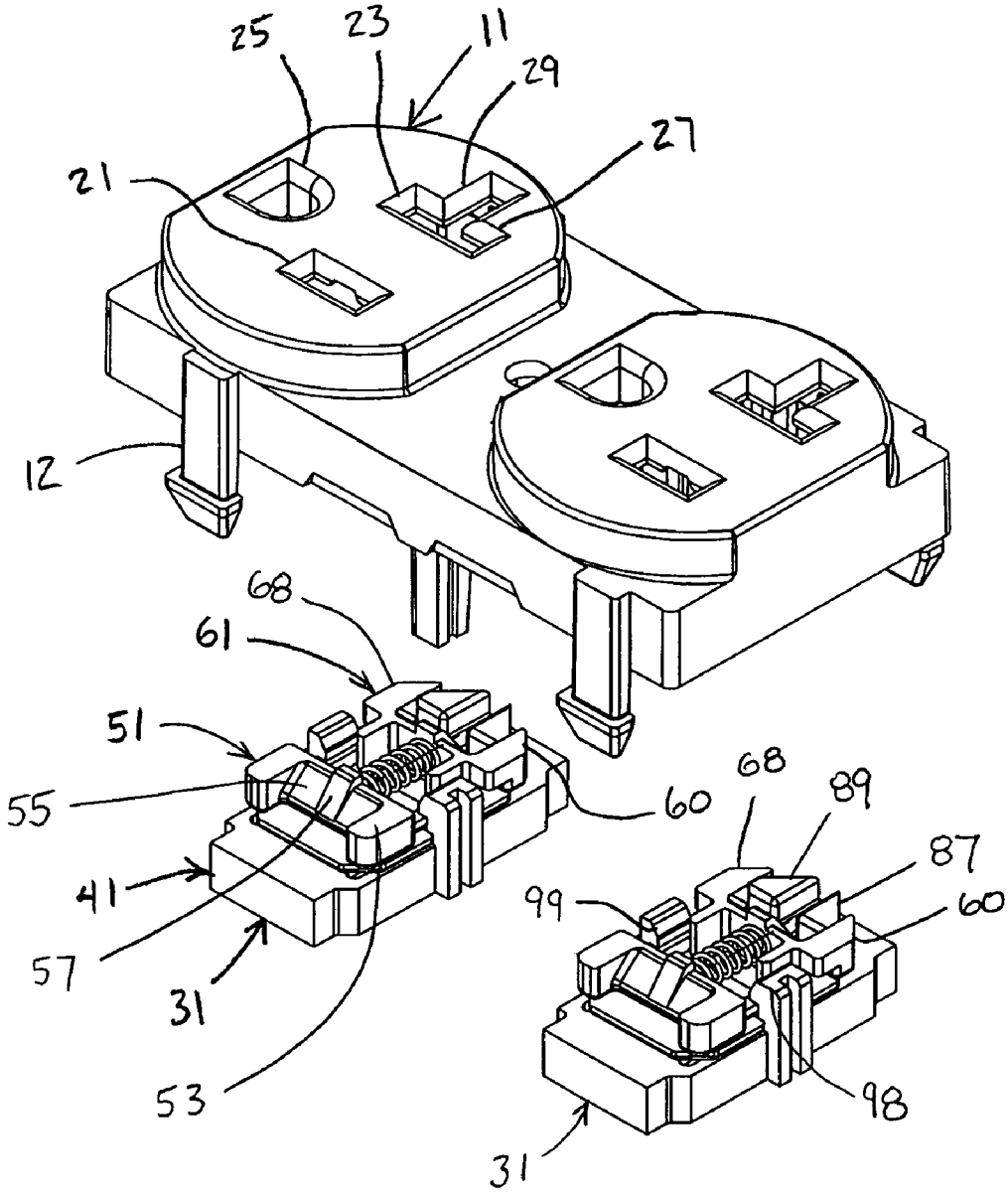
FIG. 4 is a perspective view of the tamper resistant assembly of FIG. 2 prior to being connected to a front cover of an electrical receptacle.

Referring to FIG. 4, the cam body 53 and cam surface 55 are disposed adjacent the first opening 21 such that a plug blade 22 inserted therein contacts the accelerator ramp 57 of the cam surface 55, thereby moving the first shutter member 21 to the right.

The second shutter member 61 has at one end thereof a third blocking portion 62, which is substantially planar and faces toward the first opening 21 in the front cover 11 of the electrical receptacle 10 through which a plug blade is inserted. The third blocking portion 62 is positioned below the first opening 21 to prevent a foreign object or a single plug blade inserted therethrough from contacting the electrical contact. The third blocking portion 62 is disposed beneath the cam surface 55 of the first shutter member. Thus, when a foreign object or a single plug blade is inserted through the first opening 21, the object engages the cam surface 55 and moves the first shutter member 51. However, because nothing engages the cam surface 65, the second shutter member 61 does not move such that the inserted foreign object contacts the blocking portion 62 of the second shutter member 61. When the foreign object is removed, the spring member 33 returns the second shutter member 61 to its original position. Third and fourth protrusions 90 and 92 extend rearwardly from the third blocking portion 62 of the second shutter member 61.

The second shutter member 61 also includes a second cam body 63 having an inclined cam surface 65 formed thereon. An accelerator ramp 67 is disposed on the cam surface 65 and is raised above the cam surface. The accelerator ramp 67 is preferably centrally located on the cam surface 65. The accelerator ramp 67 is adapted to be engaged by various sized plug blades from different manufacturers and accelerates the movement of the second shutter member 61 to compensate for the different manufacturers' plug designs. The cam surface 65 faces away from the third blocking portion 62. The second cam body 63 is connected to the third blocking portion 62 by a connecting portion 64. A second opening 69 is disposed in the third blocking portion 62 of the second shutter member 61. Preferably, the second opening 69 is substantially rectangular. A generally cylindrical guide rod 66 extends outwardly from the second cam body 63 toward the third blocking portion 62 and is adapted to receive an end 34 of the compression coil spring 33, which urges the first and second shutter members 51 and 61 toward their normal, relaxed position when no plug blades are present.

First and second locking arms 60 and 68 extend outwardly from the second cam body 63 in a direction away from the third blocking portion 62. Preferably, the locking arms 60 and 68 are substantially parallel. When the tamper resistant assembly is assembled, as shown in FIGS. 2 and 4, the second blocking portion 81 of the first shutter member 51 is disposed between the first and second locking arms 60 and 68 of the second shutter member 61. The first and second locking arms 60 and 68 prevent separation of the second blocking portion 81, such that a foreign object or single plug blade inserted in the second portion 29 of the second opening 23 in the front cover 11 is prevented from contacting the electrical contact.

The shutter assembly 31 is shown assembled in FIGS. 2, 4 and 5. A first protrusion 91 extends rearwardly from the first resilient arm 83 and a second protrusion 93 extends rearwardly from the second resilient arm 85, as shown in FIG. 5. The locking arms 60 and 68 maintain the first and second resilient arms 83 and 85 together, such that no gap is formed in the blade entry slot 82 defined by the first and second resilient arms 83 and 85. As shown in FIG. 3, the first and second resilient arms 83 and 85 are chamfered toward the blade entry slot 82 to permit easy entry of the blade.

The base member 41 is substantially rectangular in top plan view and has first and second guide grooves 42 and 44 adapted to be received by the guide ribs 24 and 26 connected to the front cover 11, as shown in FIGS. 2-5. Protrusions 44 and 46 are disposed at opposite ends of the base member 41 are adapted to fit within the front cover 11 of the electrical receptacle and match the interior contour thereof. The base member 41 has the first groove 43 and a second groove 48. Preferably, the first groove 43 is substantially T-shaped and the second groove 48 is substantially rectangular. First and second guide grooves 94 and 96 are disposed in the base member 41 and are adapted to receive the third and fourth protrusions 90 and 92 of the second shutter member 61.

When the base member 41 is properly disposed in the front cover 11, the first groove 43 is aligned with the second opening 23 in the front cover 11 and the second groove 48 is aligned with the first opening 21. As shown in FIG. 10, the base member 41 is disposed between the shutter assembly 31 and the conductive elements within the electrical receptacle. Thus, the base member 41 prevents the possibility of defeating the tamper resistant assembly by inserting a thin conductive member at an angle and bypassing the shutter members 51 and 61 to reach the conductive elements. Additionally, the upper surface of the base member 41 is substantially flat and smooth, providing a good surface for the sliding action of the shutter members 51 and 61 as a plug 20 is inserted. As best seen in FIGS. 9 and 10, back housing 13 has relatively thick and sturdy side walls and has interior recesses adapted to receive upper ends of the conductive elements of the electrical receptacle.

The base member 41 and the first and second shutter members 51 and 61 are preferably made of a thermoplastic, such as nylon or acetal. More preferably, a glass filled nylon is used to increase the structural strength and rigidity of the manufactured parts.

Assembly and Operation

The tamper resistant assembly 31 is assembled by passing the blocking portion 62 of the second shutter member through opening 59 of the first shutter member 51. The first and second shutter members are then aligned and the spring 31 is disposed therebetween. The spring 33 is then compressed and inserted between the first and second shutter member 51 and 61, as shown in FIGS. 2 and 4. A first end 32 of the spring 33 is connected to the guide rod 50 of the first shutter member 51, and the second end 34 of the spring 33 is connected to the guide rod 66 of the second shutter member 61. This subassembly, as shown in FIGS. 2, 4 and 5, is then disposed on the base 41 and is secured to the base by snaps 98 and 99. The first shutter member 51 is positioned on the base member 41, as shown in FIG. 2, such that the first and second protrusions 91 and 93 are received in the first groove 43 of the base member 41, as shown in FIG. 5. During assembly, the spring 33 also facilitates holding the first and second shutter members 51 and 61 together with the base member 41, thereby simplifying their insertion as a unit in front cover 11 of the electrical receptacle, as shown in FIG. 5. The second shutter member 61 is positioned on the base member 41 and the first shutter member 51 such that third and fourth protrusions 90 and 92 are received in the second and third grooves 94 and 96 of the base member 41. The second shutter member 61 is positioned such that the first and second locking arms 60 and 68 are disposed outwardly of the first and second resilient arms 83 and 85 of the first shutter member 51.

The electrical receptacle 10 includes the front cover 11 having a first opening 21 therein adapted to receive a first plug blade 22 of plug 20 and a second opening 23 adapted to receive a second plug blade 28 lying in a plane substantially parallel to the plane containing the plug blade passing through the first opening 21, as shown in FIG. 10. The first opening 21 is also adapted to receive a plug 80 having a plug blade 86 that is substantially perpendicular to the plug blade 84 passing through the first opening 21, as shown in FIG. 11.

As plug blades 22 and 28 are inserted through first and second openings 21 and 23, respectively, as shown in FIG. 10, the blades 22 and 28 contact cam surfaces 65 and 55, respectively. As plug blade 22 contacts cam surface 55, the first shutter member 51 is moved to the right as viewed in FIG. 10, thereby moving blocking portion 52 to the right so that the blocking portion 52 no longer obstructs the path between front cover opening 23, the first shutter member opening 59 and the first groove 43 in the base 41 for blade 28. Additionally, projections 87 and 89 are extracted from their locking position within the locking arms 60 and 68, thereby permitting outward movement of the first and second resilient arms 83 and 85 to admit a plug blade to pass through the second portion 29 of the front cover opening 23 and through the gap formed between the first and second resilient arms 83 and 85. As will be recognized, this does not require any separation of gap in the blade entry slot 82. When plug blade 28 is parallel to plug blade 22, the plug blade passes through the first portion 27 of front cover opening 23, the first shutter member opening 59 and the second portion 47 of the first groove 43 of the base member 41. When the plug blade 28 is perpendicular to plug blade 22, the plug blade 28 passes through the second portion 29 of front cover opening 23, the gap formed in the blade entry slot 82 when the first and second resilient arms 83 and 85 move outwardly, and through portions of the first portion 45, locking portion 49 and second portion 47 of the first groove 43 in the base member 41.

At the same time that blade 22 is moving the first shutter member 51 to the right, blade 28 is acting against cam surface 65 to move the second shutter member 61 to the left as viewed in FIG. 10. Additionally, this action moves the second shutter member opening 69 so that a blade 22, if present, may pass through the second shutter member opening 69 and the second base groove 48.

During the insertion of the plug blades 22 and 28, guide rods 50 and 66 move toward each other, thereby compressing the spring 33. Upon removal of the plug blades, the spring 33 returns the shutter members 51 and 61 to their original position, as shown in FIG. 4.

Figure 7:
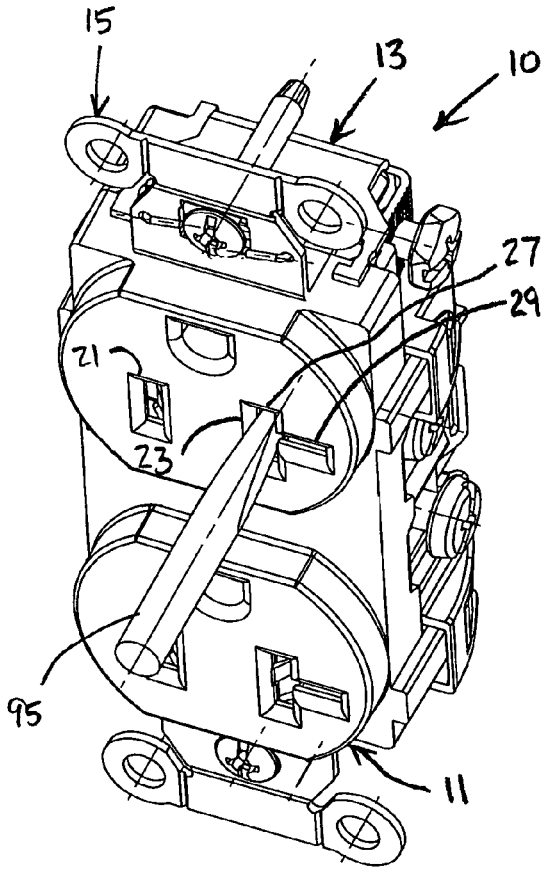
FIG. 7 is a front perspective view of a foreign object being inserted in a slot in the front cover of the electrical receptacle of FIG. 1.
Figure 8:
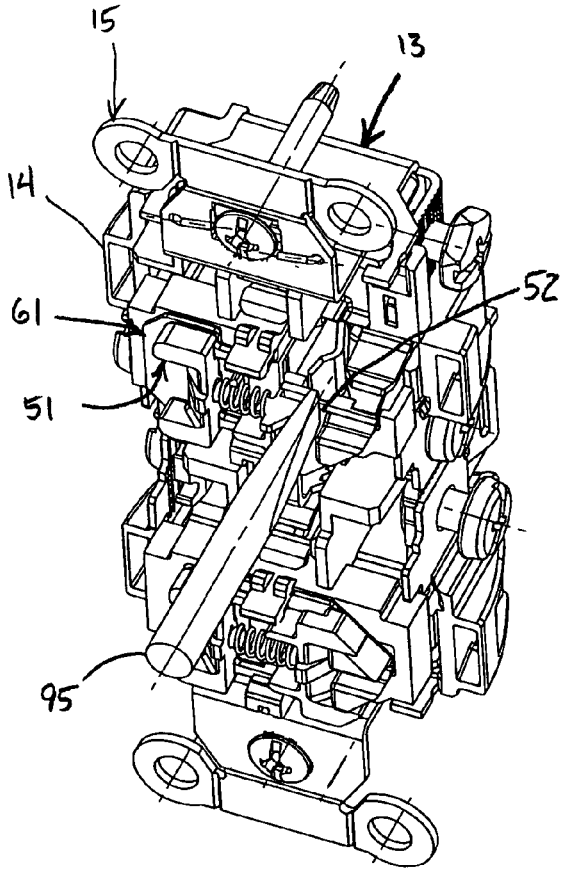
FIG. 8 is the front perspective view of FIG. 7 in which the front cover and a portion of the tamper resistant assembly has been removed for clarity.

However, insertion of a foreign object, such as a single blade-like article, in either the first or second openings 21 and 23 is prevented from accessing the conductive elements by the tamper resistant assembly 31, as shown in FIGS. 7-9. For example, as shown in FIGS. 7 and 8, a blade 95 is inserted in the first portion 27 of the second opening 23 in the front cover 11 engages cam surface 65 of the second shutter member 61, thereby moving the second shutter member 61 to the left. However, the blade 95 is prevented from accessing the conductive element because blocking portion 52 of the first shutter member 51 blocks access thereto. Similarly, insertion of a foreign object, such as an incorrectly inserted plug 20 as shown in FIG. 9, is prevented from accessing the conductive elements by the tamper resistant assembly 31. Inserting blade 28 in the first opening 21 in the front cover 11 engages cam surface 55 of the first shutter member 51, thereby moving the first shutter member 51 to the right. However, the plug blade 28 is prevented from accessing the conductive element because blocking portion 62 of the second shutter member blocks access thereto. Thus, access to the conductive elements in the electrical receptacle 10 is prevented unless both first and second shutter members 51 and 61 are engaged and moved by a correctly inserted plug 20.

When a foreign object is inserted in the second portion 29 of the second opening 23 in the front cover 13, the foreign object is prevented from accessing the conductive element by the tamper resistant assembly 31. The inserted object contacts the blade entry slot 82 of the first shutter member. However, the first and second resilient arms 83 and 85 forming the blade entry slot 82 are prevented from separating by the locking arms 60 and 68 of the second shutter member 61. Furthermore, the first and second projections 91 and 93 engage the locking portion 49 of the first groove 43 of the base member (FIG. 5), thereby further preventing outward movement of the first and second resilient arms 83 and 85. The locking portion 49 prevents the resilient arms 83 and 85 of the first shutter member 51 from opening with a small amount of force.

When a plug 80 is properly inserted, as shown in FIG. 11, the plug blade 84 engages the cam surface 55 of the first shutter member 51, thereby moving the first and second protrusions 91 and 93 out of the locking portion 49 and into the first portion 45 of the first groove 43 of the base member 41. The first and second protrusions 91 and 93 are now free to move outwardly into the first portion 45 of the first groove 43 of the base member 41 upon proper insertion of a plug blade 86 through the second portion 29 of the second opening 21 of the front cover 13. The plug blade 86 contacts the cam surface 65 of the second shutter member 61, thereby sliding the second shutter member to the right as shown in FIG. 11. The sliding movement of the second shutter member 61 is facilitated by the third and fourth protrusions 90 and 92 of the second shutter member 61 being guided by the first and second guide grooves 94 and 96 of the base member 41. Such sliding movement of the second shutter member moves the locking arms 60 and 68 to a position such that the locking arms 60 and 68 do not block outward movement of the resilient arms 83 and 85 and the projections 87 and 89 as the plug blade 86 passes through the gap formed in the blade entry slot 82, thereby moving the first and second projections 91 and 93 into the outer portions of the first portion 45 of the first groove 43 of the base member 41.

While one advantageous embodiment has been chosen to illustrate the invention, it will be understood by those skilled in the art that various changes and modifications may be made therein without departing from the scope of the invention as defined in the appended claims.

What is claimed is:

1. A tamper resistant assembly for an electrical receptacle to receive a plug having contacts, comprising:

a base member;

a groove having a locking groove portion connected in between a first groove portion and a second groove portion in said base member;

a shutter member slidably connected to said base member and having first and second resilient arms; and first and second protrusions extending downwardly from bottoms of said first and second resilient arms, respectively, and being movably received in said groove in said base member, said first and second protrusions being disposed in said locking portion of said groove when said shutter member is in a closed position and in said first portion when said shutter member is in an open position, said locking portion preventing separation of said first and second protrusions in the close position to prevent said first and second resilient arms from being separated and to prevent insertion of an object therebetween;

wherein said first and second groove portions of said groove are wider than said locking groove portion.

2. The tamper resistant assembly of claim 1, wherein when said shutter member is in said open position, said first and second protrusions are in said first portion of said groove such that an inserted object separates said first and second resilient arms as said first portion allows lateral separating movement of said first and second protrusions.

3. The tamper resistant assembly of claim 1, wherein said shutter member has a first blocking portion connected to said first and second resilient arms.

4. The tamper resistant assembly of claim 3, wherein a cam surface is connected to said first blocking portion, said cam surface being engaged by an inserted object to move said shutter member.

5. The tamper resistant assembly of claim 4, wherein said cam surface has an accelerator ramp adapted to receive a variety of plug blade sizes, said accelerator ramp oriented at an angle relative to said cam surface.

6. A tamper resistant assembly for an electrical receptacle to receive a plug having contacts, comprising:

a base member;

a groove having a locking groove portion connected in between a first groove portion and a second groove portion in said base member;

a first shutter member slidably connected to said base member and having first an second resilient arms;

a second shutter member slidably connected to said base member and having first and second locking arms;

first and second protrusions extending downwardly from bottoms of said first and second resilient arms, respectively, and being movably received in said first groove in said base member, said first and second protrusions being disposed in said locking portion of said first groove when said first shutter member is in a closed position and in said first portion when said first shutter member is in an open position, said locking portion preventing separation of said first and second protrusions in the closed position to prevent said first and second resilient arms from being separated and to prevent insertion of an object therebetween; wherein said first and second groove portions of said groove are wider than said locking groove portion.

7. The tamper resistant assembly of claim 6, wherein when said first and second shutter members are in open positions, said first and second protrusions are in said first portion of said first groove such that an inserted object separates said first and second resilient arms as said first portion allows lateral separating movement of said first and second protrusions.

8. The tamper resistant assembly of claim 5, wherein said base member has second and third grooves therein; and third and fourth protrusions extend rearwardly from said second shutter member, said third protrusion being slidably received by said second groove and said fourth protrusion being slidably received by said third groove thereby guiding movement of said second shutter.

9. The tamper resistant assembly of claim 6, wherein said first and second resilient arms are disposed between said first and second locking arms when said first and second shutters are in closed positions.

10. The tamper resistant assembly of claim 6, wherein a spring is disposed between said first and second shutter members to bias said first and second shutter members to closed positions thereof.

11. The tamper resistant assembly of claim 6, wherein each of said first and second shutter members has a cam surface with an accelerator ramp adapted to receive a variety of plug blade sizes, each said accelerator ramp being angularly oriented relative to said respective cam surfaces.

12. An electrical receptacle, comprising:

a front cover having first and second guide ribs connected thereto;

a back housing secured to said front cover;

a tamper resistant assembly disposed between the front cover and the back housing, including a base member having first and second guide grooves received by said first and second guide ribs to align said tamper resistant assembly with said front cover;

a first groove having a locking portion connected to a first portion in said base member;

a first shutter member slidably connected to said base member and having first and second resilient arms; and first and second protrusions extending downwardly from bottoms of said first and second resilient arms, respectively, and being movably received in said first groove in said base member, said first and second protrusions being disposed in said locking portion of said first groove when said first shutter member is in a closed position and in said first portion when said first shutter member is in an open position, said locking portion preventing separation of said first and second protrusions in the close position to prevent said first and second resilient arms from being separated and to prevent insertion of an object therebetween; wherein said first portion of said first groove is wider than said locking portion.

13. The electrical receptacle of claim 12, wherein a second shutter member is slidably connected to said base member and has first and second locking arms; and said first and second resilient arms are disposed between said first and second locking arms when said first and second shutters are in closed positions.

14. The electrical receptacle of claim 13, wherein when said first and second shutter members are in said open position said first and second protrusions are in said first portion of said first groove such that an inserted object separates said first and second resilient arms as said first portion does not restrict movement of said first and second protrusions.

15. The electrical receptacle assembly of claim 12, wherein said base member has first and second guide grooves therein; and third and fourth protrusions extend rearwardly from said second shutter member, said third protrusion being slidably received by said first guide groove and said fourth protrusion being slidably received by said second guide groove thereby guiding movement of said second shutter member.

16. The electrical receptacle assembly of claim 12, wherein said first and second resilient arms are disposed between said first and second locking arms when said first and second shutter members are in closed positions.

17. The electrical receptacle assembly of claim 12, wherein each of said first and second shutter members has a cam surface with an accelerator ramp adapted to receive a variety of plug blade sizes, each said accelerator ramp being angularly oriented relative to said respective cam surfaces.

* * * * *